United States Patent [19]

Comstedt

[11] 4,311,438

[45] Jan. 19, 1982

[54] METHOD AND APPARATUS FOR CONTROLLING THE START OF AN INTERMITTENTLY OPERATING PUMP

[75] Inventor: Anders Comstedt, Löddeköpinge, Sweden

[73] Assignee: El-Fi Innovationer AB, Sweden

[21] Appl. No.: 96,600

[22] Filed: Nov. 21, 1979

[30] Foreign Application Priority Data

Nov. 20, 1978 [SE] Sweden ..... 7811933

[51] Int. Cl.[3] ..... F04B 49/00

[52] U.S. Cl. ..... 417/12; 417/45; 417/53

[58] Field of Search ..... 417/12, 36, 44, 45, 417/53; 318/444, 445, 447, 484; 307/141, 141.4

[56] References Cited

U.S. PATENT DOCUMENTS

| | | | |
|---|---|---|---|
| 3,191,114 | 6/1965 | Reed | 318/447 X |
| 3,283,236 | 11/1966 | Legg | 318/445 X |
| 4,171,932 | 10/1979 | Miller | 417/44 X |
| 4,201,517 | 5/1980 | Ferguson | 417/12 |

*Primary Examiner*—William L. Freeh
*Assistant Examiner*—Edward Look
*Attorney, Agent, or Firm*—Karl W. Flocks; A. Fred Starobin

[57] ABSTRACT

Renewed starting of an intermittently operating pump is controlled in that the running time of the pump from the last start thereof is measured by means of a running time gauge the measuring value of which is maximized, and in that the pause time commencing at the end of the running time is controlled by start delaying means in dependence on the duration, measured by the running time gauge, of the preceding running time such that a long running time gives a short pause time and a short running time gives a long pause time.

7 Claims, 3 Drawing Figures

METHOD AND APPARATUS FOR CONTROLLING THE START OF AN INTERMITTENTLY OPERATING PUMP

BACKGROUND OF THE INVENTION

This invention relates to a method and an apparatus for controlling the start of an intermittently operating pump.

When operating pumps, particularly submersible drainage pumps, it is desirable to avoid dry running and for this reason the pump is shut off by level sensing or load sensing means. The pump shall then be restarted when the pumped medium flows again. For this purpose use has earlier been made of various kinds of level sensing means. These are however disadvantageous in that they are sensitive to dirt and exposed to corrosion. Prior art apparatuses moreover are not explosion proof.

There is thus the need for an apparatus for restarting intermittently operating pumps, which is devoid of the above disadvantages.

SUMMARY

According to the invention, this need can be satisfied by performing the control of the start of such a pump in the following manner. The running time of the pump from the last start is measured and at the end of the running time the duration of the following pause time is determined in dependence on the measured duration of the preceding running time such that a long running time gives a short pause time and a short running time gives a long pause time. According to the present invention, an apparatus for realizing this method of controlling an intermittently operating pump comprises a running time gauge for measuring the running time of the pump from the last start thereof and start delay means coupled to the running time gauge for starting the pump with a variable time delay after the end of the running time, said time delay being dependent on the duration, measured by the running time gauge, of the preceding running time such that a long running time gives a short pause time and a short running time gives a long pause time.

BRIEF DESCRIPTION OF THE DRAWINGS

The invention will now be described in greater detail below, reference being made to the accompanying drawings in which.

DESCRIPTION OF THE PREFERRED EMBODIMENTS

Figure 1:
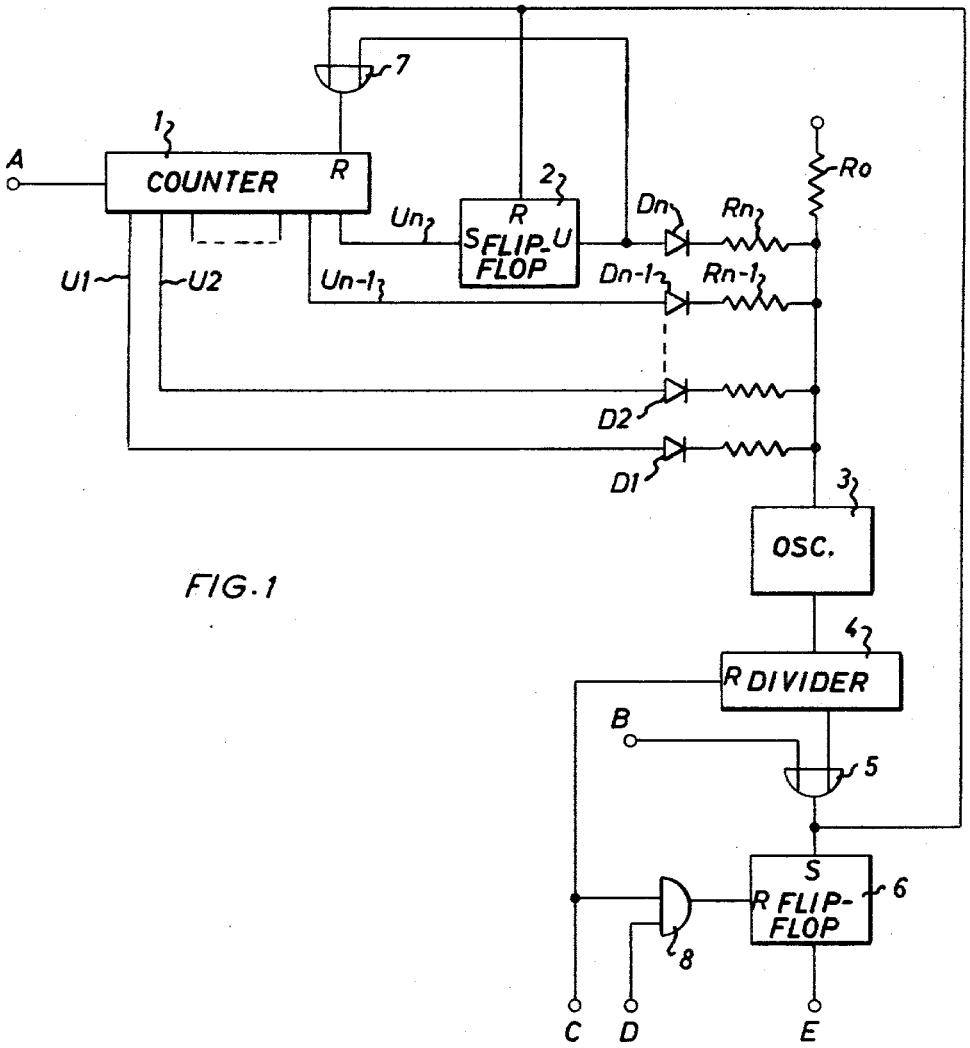
FIG. 1 is a combined block and circuit diagram of a first embodiment of the apparatus according to the invention.

According to FIG. 1 to which reference is made a binary counter 1 has a counting input A, a zeroizing input R and a plurality of outputs U1, U2, . . . Un of which output Un represents the most significant bit and is connected to the setting input S of a bistable RS flip-flop 2. Each of the outputs U1, . . . Un-1 of the counter 1 and the output U of the flip-flop 2 is coupled via its respective diode D1, D2, . . . Dn in series respectively with a resistor R1, R2, . . . Rn to the input of a current controlled oscillator 3 the output of which is coupled to the input of a divider 4 to supply thereto a pulse train the frequency of which is dependent on the level of the current supplied to the input of the oscillator 3 and more particularly increases with increasing current intensity. The output of the divider 4 is connected via an OR-gate 5 to the set input S of a RS flip-flop 6. Upon energization, a pulse representing a logical "1" is applied to the second input B of the OR-gate 5. The output of the OR-gate 5 is also coupled to the reset input R of the RS flip-flop 2 and to the zeroizing input R of the counter 1 via an OR-gate 7 which also has an input connected to the output U of the RS flip-flop 2. The divider 4 has a reset input R which is connected to an input C to which circuits (not shown in FIG. 1) apply a signal representing a logical "1" when current is supplied to the pump motor in question (not shown). The input C and an input D are coupled via an AND-gate 8 to the reset input R of the RS flip-flop 6. A signal representing a logical "1" is applied to the input D when a load sensor (not shown in FIG. 1) detects that the pump motor 1 is under low load. This state, which is equivalent to dry running, can of course also be detected in another manner. The output E of the RS flip-flop 6 controls connection and disconnection of the pump motor.

The apparatus described above operates in the following manner. When the apparatus is made operative by energization the logical "1" which occurs on one input of the OR-gate 5 will zeroize the counter 1, reset the RS flip-flop 2 and set the RS flip-flop 6, whereby the signal at the output of RS flip-flop 6 starts the pump motor. This will reset the divider 4 and keep it reset as long as the pump motor is supplied with current. During the running time of the pump the counter 1 counts at a rate determined by the frequency of the pulses at the input A (for example 50 Hz). If the counter 1 reaches a state in which the output Un shows a level corresponding to a logical "1" the RS flip-flop 2 will be set, the output signal thereof zeroizing the counter 1 and keeping it zeroized. When a low load indication occurs at the input D the RS flip-flop 6 will be reset. This results in that the supply of current to the pump motor ceases and thereby resetting of the divider 4 ceases. The frequency of the pulse train produced by the oscillator 3 is dependent on the diodes D1, . . . Dn and resistors R1, . . . Rn via which current is supplied. For example, by making the resistance of the resistor $R\upsilon+1$ half as large as that of the resistor $R\upsilon$ ($\upsilon=1,2, \ldots n-1$) the frequency of the oscillator 3 will at the end of the running time increase with the duration of the running time up to a maximum value which is thus determined by the resistance of the resistor Rn. When after resetting has ceased the divider 4 has received a predetermined number of pulses from the oscillator 3 said divider produces a signal at its output for setting of the RS flip-flop 6. This results in the pump motor being again started at the same time as the counter 1 is zeroized and the RS flip-flop 2 is reset. The course of operation described is then repeated.

It will thus be realized that the duration of the pause time commencing at the end of running time is controlled in dependence on the duration, measured by the counter 1, of the preceding running time such that a long running time gives a short pause time and, conversely, a short running time gives a long pause time. It will further be realized that the pause time is longer than a given minimum value determined by the resistance of the resistor Rn and shorter than a given maximum value determined by the resistance of a resistor RO interposed between the input of the oscillator 3 and a voltage source. The relation RO:Rn primarily determines the characteristics of the oscillator 3. A running time longer or shorter than given values do not thus further affect the duration of the pause time.

Figure 2:
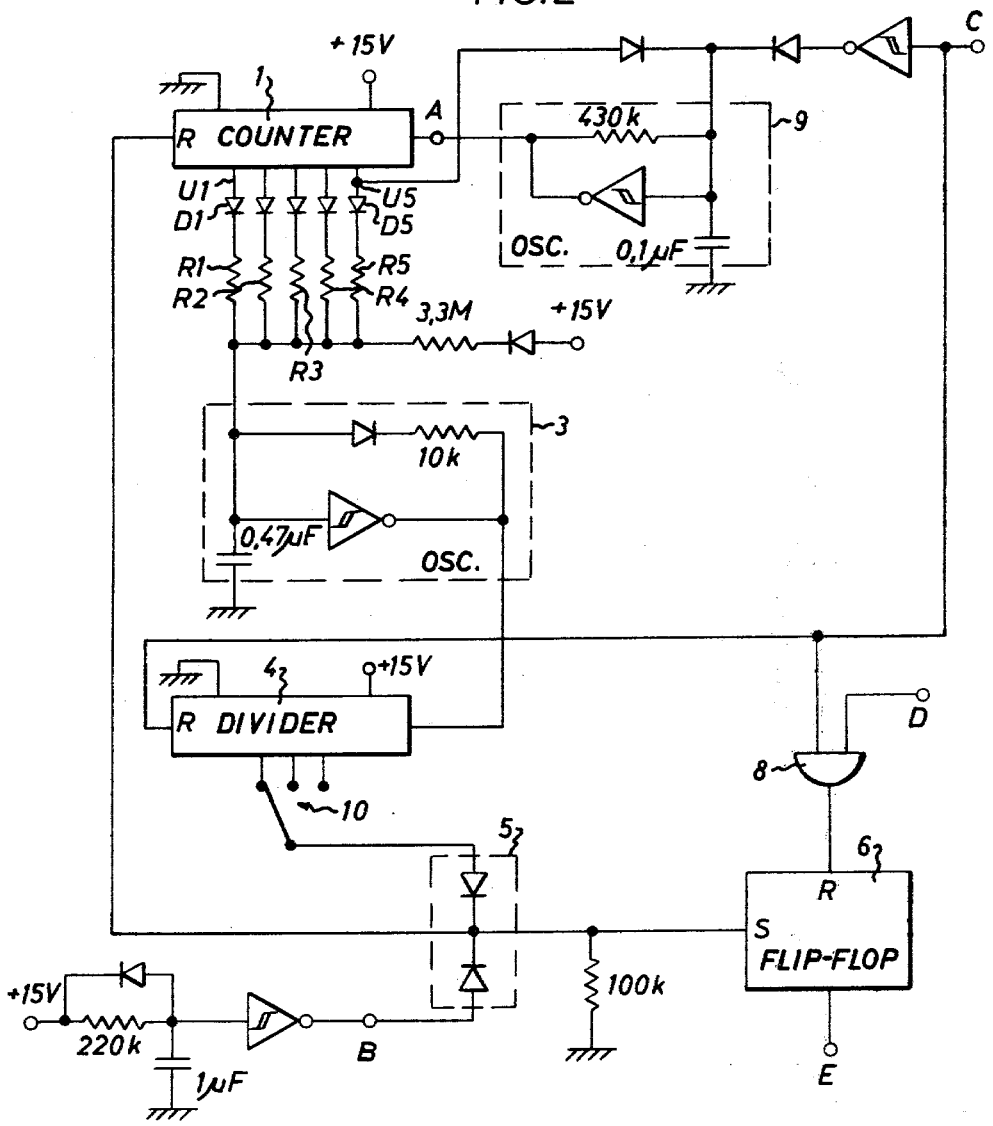
FIG. 2 shows a preferred modified embodiment of the apparatus in FIG. 1.

The embodiment of the present invention shown in FIG. 2, which is preferred at present, substantially agrees with that illustrated in FIG. 1. Thus, the same counter 1, oscillator 3, divider 4, flip-flop 6, and gates 5 and 8 can be utilized, whereas the flip-flop 2 and the gate 7 are lacking in the embodiment of FIG. 2. A second oscillator 9 comprising a Schmitt trigger, a resistor and a capacitor has an output which is connected to the counting input A of the counter 1, and a control input connected via diodes, on the one hand, to the highest significance output of the counter 1 and, on the other hand, to the output of a Schmitt trigger, the input of which is the same as the input C in FIG. 1. It will be realized that the oscillator 9 swings only when the pump motor is supplied with current and the counter 1 has not counted up to the most significant bit. As a result, it has been possible to leave out the flip-flop 2 in the embodiment according to FIG. 1 so that the current control of the oscillator 3 takes place without the aid of said flip-flop. The divider 4 coupled to the output of the oscillator 3 can be a counting circuit of the type CD 4040, which also applies to the counter 1. As shown in FIG. 2, a selector switch 10 can connect one of three different significance outputs of the divider 4 to one input of the gate 5 whereby the maximum pause time is adjustable at three different values. The second input of the gate 5, which in FIG. 2 is shown as a diode gate, is coupled to the output of a Schmitt trigger whose input is coupled to an RC section to which voltage (+15 V) is applied upon energization of the apparatus according to the invention. The output of the gate 5 is directly connected to the setting input of the flip-flop 6 and the resetting input of the counter 1.

The mode of operation of the apparatus shown in FIG. 2 substantially agrees with that of the apparatus in FIG. 1. When the apparatus is connected to a source of current supply a pulse is fed via input B to the counter 1 for resetting it, while a pulse is fed to the flip-flop 6 for setting it. As a result, a signal occurs at the output E of the flip-flop, said signal starting the pump motor via a relay. As a current is supplied to the pump motor the signal at the input C will reset the divider 4 and release the oscillator 9 which begins to swing and delivers its pulses to the counter 1. The latter will stop the oscillator 9 swinging, if and when the counter 1 reaches the state in which the most significant output shows a level corresponding to a logical "1". Otherwise, the apparatus in FIG. 2 functions in the same way as that in FIG. 1.

Figure 3:
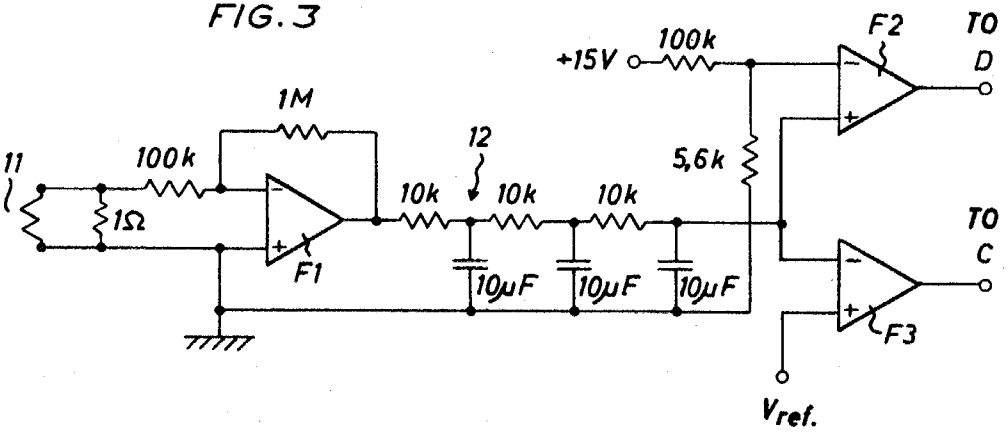
FIG. 3 shows a circuit for producing two signals utilized in the apparatus.

A circuit such as the one shown in FIG. 3 can be utilized for producing the signals supplied to the inputs C and D in FIGS. 1 and 2. This circuit has a current transformer 11 which senses the current supply to the pump motor and the output signal of which is amplified and halfwave rectified by means of a differential amplifier F1. The pulsating DC signal at the output of the amplifier F1 is converted into a smoothed DC signal by a filter 12 comprising three RC-sections. In a second differential amplifier F2 the output signal of the filter 12 is compared to a first reference voltage near OV such that the amplifier $F_2$, to the input C in FIGS. 1 and 2, delivers a signal indicating current supply to the pump motor. In a third differential amplifier F3 the output signal of the filter 12 is compared to a second reference voltage $V_{ref}$ which can be preset in such a way that the amplifier F3 at its output delivers a signal when the load of the pump motor is below a predetermined value.

An integrated circuit of the type LM224 can be used as differential amplifiers F1, F2 and F3. The Schmitt trigger circuits comprised in the embodiment according to FIG. 2 can for example be Schmitt trigger circuits in an integrated circuit of the type 74C14.

It will readily be seen that a great many modifications are conceivable within the scope of the invention. Thus, any suitable running time gauge for measuring the running time of the pump can thus be substituted for the counter 1 and the RS flip-flop 2. Likewise, any suitable start delay means which after the end of a running time can delay a new start of the pump for a time which in the manner mentioned is dependent on the running time measured by the running time gauge, can be substituted for the oscillator 3 and the divider 4.

What I claim and desire to be secured by Letters Patent is:

1. A method of controlling the start of an intermittently operating pump, characterized by measuring the running time of the pump drive motor from the last start thereof and controlling the duration of the pause time commencing at the end of the running time in dependence on the measured duration of the preceding running time such that the pause time increases for decreasing running times at least between a first predetermined running time and a second predetermined running time, shorter than said first running time.

2. The method of claim 1 characterized by giving the pause time a minimum value for running times longer than said first predetermined running time.

3. The method of claim 1 or 2 characterized by giving the pause time a maximum value for running times shorter than said second predetermined running time.

4. An apparatus for controlling the start of an intermittently operating pump, characterized by a running time gauge (1, 2) for measuring the running time of a pump drive motor from the last start thereof and start delay means (3, 4) coupled to said running time gauge and said pump drive motor for starting said pump drive motor with delay after the end of the running time, the duration of said delay being dependent on the duration, measured by said running time gauge, of the preceding running time such that the pause time increases for decreasing running times at least between a first predetermined running time and a second predetermined running time, shorter than said first running time.

5. The apparatus of claim 4 characterized by the fact that said start delaying means comprise an oscillator (3) the oscillation frequency of which is determined by the running time measured by said running time gauge (1, 2), and a divider (4) coupled to the output of said oscillator.

6. The apparatus of claim 4 or 5, characterized by the fact that the running time gauge comprises a counter (1) the highest significance output of which is coupled to a flip-flop (2) for resetting the counter.

7. The apparatus of claim 4 or 5, characterized by the fact that said running time gauge comprises a counter (1) the highest significance output of which is coupled to a control input of an oscillator (9) the output of which is coupled to the counting input (A) of said counter (1).

* * * * *